United States Patent [19]

Wagner et al.

[11] Patent Number: 5,077,465

[45] Date of Patent: Dec. 31, 1991

[54] GYRO-STABILIZED SEEKER

[76] Inventors: Eric Wagner, Friedhofstr. 37, 7770 Überlingen; Peter Giesenberg, Schulstrasse 1, 7777 Salem 1; Rainer Flickinger, Fischeräcker 6, 7965 Ostrach 1, all of Fed. Rep. of Germany

[21] Appl. No.: 563,433

[22] Filed: Aug. 7, 1990

[30] Foreign Application Priority Data

| | | | |
|---|---|---|---|
| Aug. 7, 1989 | [DE] | Fed. Rep. of Germany | 3925942 |
| Nov. 17, 1989 | [DE] | Fed. Rep. of Germany | 3938705 |
| Dec. 7, 1989 | [DE] | Fed. Rep. of Germany | 3940512 |

[51] Int. Cl.[5] ..... G02B 27/17; G01J 1/20

[52] U.S. Cl. ..... 250/203.1; 244/3.16

[58] Field of Search ..... 250/203.1, 231.12, 234–236; 350/6.9, 6.91; 244/3.16; 356/148, 149, 141, 152

[56] References Cited

U.S. PATENT DOCUMENTS

| | | | |
|---|---|---|---|
| 3,752,998 | 8/1973 | Stripling et al. | 250/203.1 |
| 4,009,393 | 2/1977 | Ashley, Jr. et al. | 250/339 |
| 4,010,365 | 3/1977 | Meyers et al. | 244/3.16 |
| 4,030,807 | 6/1977 | Briney | 350/7 |
| 4,039,246 | 8/1977 | Voigt | 250/203.1 |
| 4,413,177 | 11/1983 | Godwin, Jr. et al. | 250/236 |
| 4,427,878 | 1/1984 | Buchtel et al. | 250/236 |
| 4,500,051 | 2/1985 | Cottle, Jr. et al. | 244/3.16 |
| 4,717,822 | 1/1988 | Byren | 250/203.1 |
| 4,738,412 | 4/1988 | Ozunas | 244/3.16 |
| 4,949,917 | 8/1990 | Cottle, Jr. et al. | 244/3.16 |

FOREIGN PATENT DOCUMENTS

| | | |
|---|---|---|
| 0079684 | 5/1983 | European Pat. Off. . |
| 3438544C2 | 4/1986 | Fed. Rep. of Germany . |
| 3519786A1 | 12/1986 | Fed. Rep. of Germany . |

*Primary Examiner*—Davis L. Willis
*Assistant Examiner*—S. Allen
*Attorney, Agent, or Firm*—Lee, Mann, Smith, McWilliams & Sweeney

[57] ABSTRACT

A gyro-stabilized seeker comprises a rotor which is mounted universally movably about a central point and arranged to be driven about a rotor-fixed axis of rotation passing through the central point, as well as an imaging optical system on the rotor which is arranged to image a field of view in a plane perpendicular to the axis of rotation of the rotor. Detector means (130) for generating target signals are located in this plane. The detector means are arranged at a structure-fixed heat-insulating cooler housing (120) and are cooled by a cooler. The axis of rotation is aligned to a target. A convexo-spherical bearing surface (124) is structure-fixedly attached to the cooler housing (120). The detector means (130) are located on a carrier (128) which is universally pivotably mounted on this convexo-spherical bearing surface (124) and are aligned by a rotor carrier (106) according to the axis of rotation of the rotor. The convexo-spherical bearing surface (124) is connected to the cooler housing (120) through resilient connecting means (156) permitting alignment of the central point of the bearing surface to the central point of the rotor bearing.

18 Claims, 5 Drawing Sheets

GYRO-STABILIZED SEEKER

TECHNICAL FIELD

The invention relates to a gyro-stabilized seeker, comprising (a) a rotor which is mounted universally movably about a central point and arranged to be driven about a rotor-fixed axis of rotation passing through the central point.

(b) an imaging optical system on the rotor which is arranged to image a field of view in a plane perpendicular to the axis of rotation of the rotor, (c) detector means upon which the field of view is imaged by the optical system for generating target signals, (d) means for generating aligning signals from the target signals, (e) a structure-fixed cooler housing at which the detector means are arranged.

(f) means for cooling the detector means, and (g) aligning means to which the aligning signals are applied for aligning the axis of rotation of the rotor to a target.

BACKGROUND ART

Various types of gyro-stabilized seekers having an imaging optical system arranged on the rotor and imaging a field of view in the plane of a detector are known. The rotor decouples the optical system from the movements of the structure, e.g. of a target seeking missile. As a rule the detector is formed of one single detector element. For increasing the sensitivity this detector is located in a Dewar vessel and is cooled by a Joule-Thomson cooler.

The arrangement of the detector in a Joule-Thomson cooler requires the detector to be structure-fixed, that means, e.g., to be attached to the structure of a missile controlled by the seeker. It is constructively not possible to arrange the Dewar vessel with the Joule-Thomson cooler on the rotor.

The detector supplies target signals which, correspondingly processed as aligning signals, cause the rotor with its axis of rotation to be aligned to a target. With this alignment of the rotor to the target a "squint angle" occurs, that means an angle between the axis of rotation of the rotor and a structure-fixed reference axis, e.g. the longitudinal axis of a missile.

An image processing is necessary for catching and recognizing a target. To this end the observed field of view has to be decomposed into image elements (pixels). With one single detector element this requires an image scanning: The image of the detected field of view has to be movable relative to the stationary detector element. As a rule this is achieved by means of a "rosette-scanning" which is effected by superimposing two gyrating motions. With such a rosette-scanning practically all points of the detected field of view are detected by the detector at least once during each cycle. One of the gyrating motions for generating a rosette-scanning is generally derived from the rotation of the rotor.

The generation of a rosette-shaped scanning path requires an expensive mechanism. Furthermore, the scanning is reatively slow.

Following publications are examples of gyro-stabilized seekers having rosette-scanning: U.S. Pat. No. 4,009,393, U.S. Pat. No. 4,030,807, U.S. Pat. No. 4,039,246, U.S. Pat. No. 4,413,177, U.S. Pat. No. 4,427,878, EP-A-79 684, DE-C-34 38 544 and DE-A-35 19 786.

As a rule, the optical systems are constructed in the manner of a Cassegrain system. They comprise, as primary mirror, an annular concave mirror facing the field of view and, as secondary mirror, a plane mirror facing the detector as well as, in general, additional refracting optical elements. The primary mirror forms the substantial gyrating mass of the rotor.

Linear and two-dimensional arrangement of detector elements are known which are adapted to decompose an image generated thereon into image elements. It is known that such detector arrangements are arranged on chips.

Optical problems arise now when using such not almost punctual detectors in a seeker of the present type. The detector in the Dewar vessel is necessarily structure-fixed. However, the optical system and thus also the image plane in which the image of the field of view and of the target is generated, are pivoted relative to the structure when aligning to the target. This does not matter if the detector comprises a single almost punctual detector element in a central point and the pivoting of the rotor is effected about this central point. However, when the detector is a linear or two-dimensional arrangement of detector elements, then, when a squint angle occurs, the image plane is pivoted relative to the structure-fixed plane of the detector elements. Then a sharp imaging is ensured on a detector element located in the central point. However, the field of view is imaged only obscurely on the other detector elements. These detector elements are not located in the image plane of the optical system.

EP-A-0 100 124 describes an optical seeker having an optical system which is mounted universally pivotable at a structure through a gimbal arrangement and arranged on a gyro rotor and adapted to be aligned to a target.

A detector arrangement is structure-fixedly arranged. A field of view generated in the image plane of the pivotable optical system is transmitted to the structure-fixed detector arrangement through flexible optical fibres.

DE-A-3 435 634 describes a target detecting arrangement for missiles having a detector element rotating about a longitudinal axis of the missile and located behind a lens system, and a zoom lens.

DISCLOSURE OF INVENTION

It is the object of the invention to provide a gyro-stabilized seeker having a cooled detector arranged in a cooler housing and a linear or two-dimensional arrangement of detector elements.

It is a particular object of the invention to ensure, with a gyro-stabilized seeker of the mentioned type, that the field of view is sharply imaged on all of the detector elements even if a squint angle occurs, that means if the rotor is pivoted with the imaging optical system.

According to the invention this object is achieved in that (h) the detector means are arranged around the central point universally pivotably relative to the structure-fixed cooler housing and (i) coupling means are arranged to align the detector means with its plane always perpendicular to the axis of rotation of the rotor.

According to the invention the cooler housing is structure-fixed. However, the detector means, that means e.g. a two-dimensional arrangement of detector elements on a chip, are pivoted such that the plane of the detector means always is perpendicular to the axis of rotation of the rotor and thus is located with all of the detector elements in the image plane of the imaging optical system.

This can be achieved in different ways.

The cooler housing can have a cylindrical peripheral portion which forms a concavo-spherical bearing surface at its end facing the rotor. Then a hollow body can be mounted in the bearing surface of the peripheral portion, which hollow body has a convexo-spherical peripheral surface about a hollow body axis and which is closed on the side facing the rotor by a window which is transparent for radiation and perpendicular to the hollow body axis. Then an annular wall portion can be formed on the side facing the interior of the cooler housing, the central opening of the wall portion being closed by the detector means likewise perpendicular to the hollow body axis. The hollow body is coupled to the rotor through mechanical aligning elements and a bearing such that the hollow body with its hollow body axis is aligned with the axis of rotation of the rotor.

One possibility is that the rotor is mounted rotatably about the axis of rotation by means of the bearing on a non-rotating bearing portion which is mounted universally pivotable relative to the structure, and the hollow body is connected to the non-rotating bearing portion through the aligning elements.

Another posibility consists in that the aligning elements, on one hand, are attached to the hollow body and, on the other hand, are mounted directly on the rotating rotor through bearings.

A further solution according to the invention consists in that the detector means in the cooler housing are mounted universally movable about the central point and contactless aligning means are provided which are arranged to align the detector means to the axis of rotation of the rotor. The contactless aligning means suitably include magnetic means. A constructive solution of this kind consists in that the contactless aligning means comprise a pair of crossed permanent magnets at the detector means and a ring of a material of high permeability which is pivotable with the axis of rotation of the rotor, with the transverse center plane thereof including the central point.

The detector means can be formed by a detector chip. The detector chip can have a two-dimensional arrangement of detector elements. However, the detector chip can comprise a linear arrangement of detector elements. In this case the imaging optical system comprise image rotating means which rotate with the rotor.

For providing a larger squint angle a convexo-spherical bearing surface can be structure-fixedly attached to the cooler housing and the detector means can be located on a movable carrier which is mounted universally pivotable on the convexo-spherical bearing surface.

In order to permit the detector means to adapt to the position of the rotor axis even with heavy temperature variations without disturbing torques occuring at the rotor, the convexo-spherical bearing surface can be connected to the cooler housing through resilient connecting means permitting alignment of the central point of the bearing surface to the central point of the rotor bearing.

In this way the convexo-spherical bearing surface can be adapted to the concavo-spherical bearing surface of the rotor, the central point of which coincides with the central point of the rotor bearing. The convexo-spherical bearing surface is resiliently pressed into this concavo-spherical bearing surface.

Advantageously a cylindrical guiding socket is provided at the end of the peripheral surface at the side of the field of view and the convexo-spherical bearing surface is formed at a bearing body which is guided on the guiding socket with a bore having lateral clearance.

Such a construction permits a compensating movement of the bearing body in radial direction. Furthermore, the slot between the guiding socket and the bearing body constitutes a heat insulation. Therewith the cooling effect of the cooling means is concentrated on the detector means. Less heat flows from the rotor such that a sufficiently fast cooling of the detector means is ensured.

Furthermore, it is advantageous if the bearing body is connected to the peripheral surface through a spring bellows permitting an axial movement.

Such a spring bellows permits first of all an axial movement of the bearing body. However, the interior of the spring bellows also communicates with the space between the outlet nozzle of, e.g., a Joule-Thomson cooler, and detector means through the slot between the guiding socket and the bearing body. High pressures up to some bars can occur in this space. The gas emerging from the outlet nozzle shall flow through the bore of the guiding socket and the interior of the heat-insulating peripheral portion through the pressurized gas supply conduit and pre-cool the supplied pressurized gas. Therefore, the bearing surfaces shall engage each other tightly. Through the spring bellows the convexo-spherical bearing surface of the bearing body is pressed against the concavo-spherical bearing surface.

Furthermore, an advantageous construction consists in that the peripheral portion is closed at its front surface by an annular disc carrying the guiding socket and the spring bellows connects the annular disc to the bearing body.

Embodiments of the invention will now be described in greater detail with reference to the accompanying drawings.

PREFERRED EMBODIMENTS OF THE INVENTION

Figure 1:
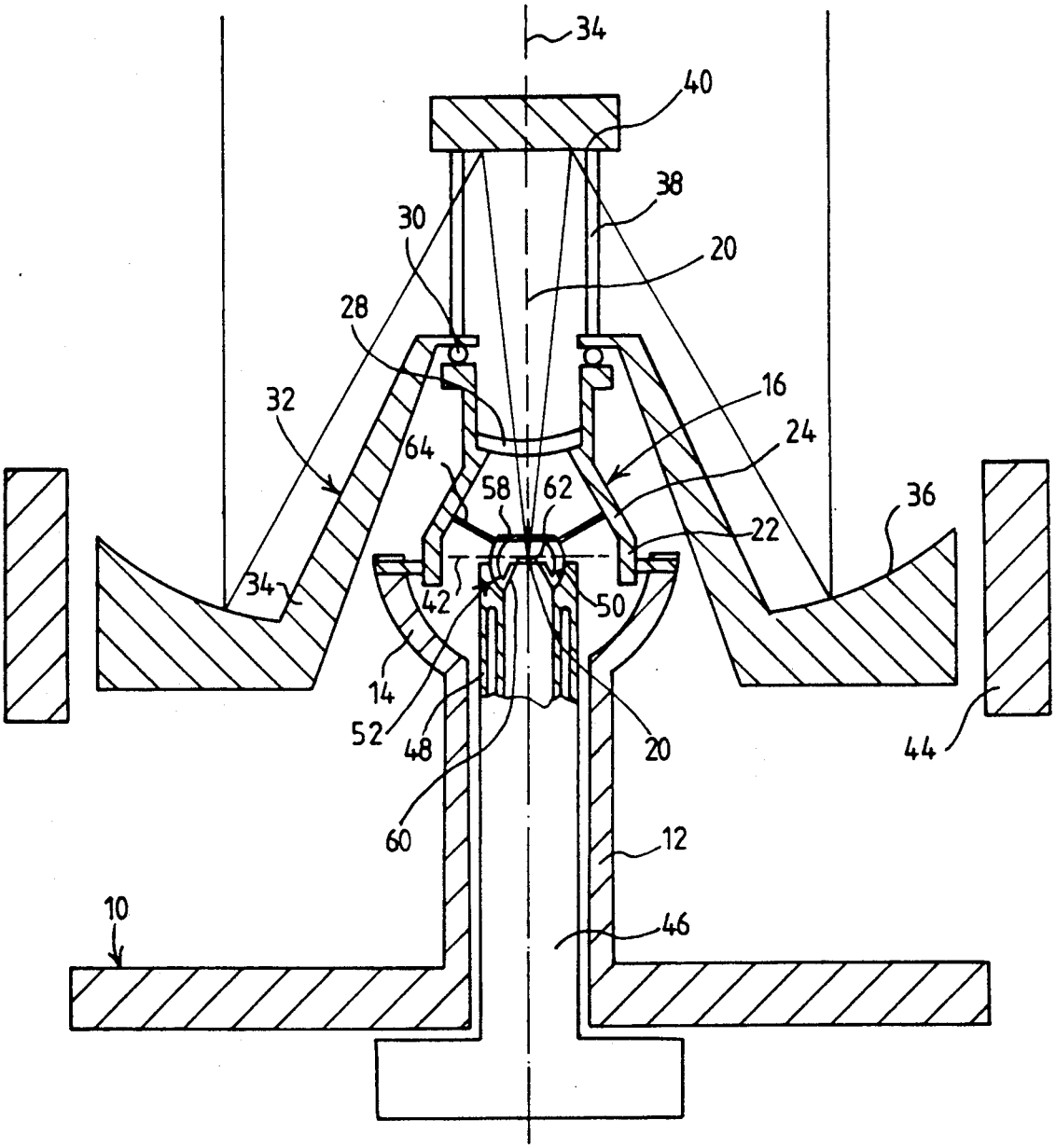
FIG. 1 shows a schematic longitudinal section of a seeker in which a detector chip is aligned with the axis of rotation of a rotor and thus with the optical axis of an imaging optical system which is gyro-stabilized by the rotor and aligned to a target.

In FIG. 1 numeral 10 designates the structure of a missile which shall be guided to a target by a seeker. The structure has a tubular portion 12 having an annular and cup-shaped end 14. A gimbal ring is mounted in the end 14 about a first gimbal axis, in which gimbal ring, in turn, a bearing body 16 is pivotably mounted about an second axis perpendicular to the first axis. Thus, the bearing body 16 is universally pivotably mounted in known manner about a central point 18. For simplifying the illustration, the bearing body 16 is illustrated in FIG. 1 as if it is mounted directly at the end 14. The bearing body 16 is a hollow body which substantially presents rotation symmetry with respect to an axis 20. The bearing body 16 has a cylindrical section 22 in which it is gimbal suspended in the end 14. A truncated section 24 is connected to the cylindrical section 22. A cylindrical section 26 having smaller diameter is located at the narrow end of the truncated section 24. A lens 28 is located in the section 26.

A rotor 32 is rotatably mounted on the bearing body 16 through a ball bearing 30. The rotor 32 rotates about an axis of rotation 34. The axis of rotation 34 coincides with the axis 20 of the bearing portion 16.

The rotor 32 has a truncated hollow central portion 34. At its narrow end the truncated central portion 34 is mounted on the bearing portion 16 through the ball bearing 30 and surrounds the bearing portion 16 and the annular and cup-shaped end 14. The central portion carries an annular concave mirror 36 at the wider end. At the same time the concave mirror 36 constitutes the substantial gyrating mass of the rotor 32. A plane mirror 40 is supported through links 38 on the narrow portion of the central portion 34. The reflecting surface of the concave mirror 36 faces the field of view to be detected. The reflecting surface of the plane mirror 40 is remote from the field of view and faces the interior of the bearing portion.

The path of rays of the optical system extends from the field of view virtually located at infinity through the concave mirror 36. From the concave mirror 36, as shown, the rays are guided to the plane mirror 40 and focused through the lens 28 in a plane 42 passing through the central point 20 and perpendicular to the axis of rotation 34. A real image of the detected field of view is generated in the plane 42.

The rotor 32 is magnetized in known manner and is driven through driving coils. Furthermore, precession coils are provided which are adapted to apply torques to the rotor which causes a precession of the rotor 32 toward a target. This is known technique and not described here in detail. In FIG. 1 the coils are generally designated by 44.

Figure 2:
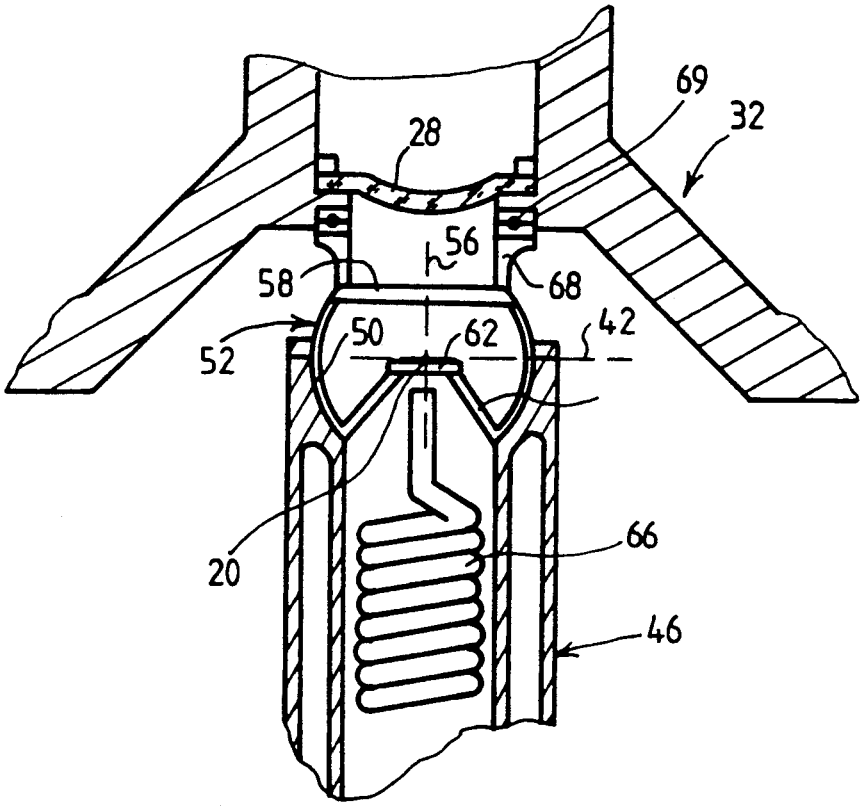
FIG. 2 shows a detail of a modified embodiment in which the detector chip is mechanically aligned directly by the rotating rotor.

A cooler housing 46 in the form of a Dewar vessel is located in the tubular portion 12. The Dewar vessel has a double-wall cylindrical peripheral portion 48. The peripheral portion 42 forms a concavo-spherical annular bearing surface 50 at its end facing the rotor. This can be seen most clearly in FIG. 2 which corresponds to FIG. 1 in this respect. The bearing surface is curved about the central point 20. A hollow body 52 is mounted in the bearing surface 50. The hollow body 52 has a convexo-spherical peripheral portion 54 presenting rotation symmetry with respect to an axis 56 (FIG. 2). On the side facing the mirror 40 the hollow body 52 is closed by a window 58 which is transparent for radiation. On the opposite side the hollow body forms a truncated wall portion 60. The narrow opening of this truncated wall portion 60 is closed by a detector chip 62. The surface of the detector chip 62 with the detector elements is located in a plane containing the central point 20. The detector chip 62 has a two-dimensional arrangement of detector elements. The hollow body 52 is directly mechanically connected to the bearing body 16 through links 64.

The hollow body consists of ceramics and is provided with a filling of dry nitrogen. Thus, it practically forms the front side of the cooler housing 46.

When the rotor 32 is pivoted relative to the structure 10 from the illustrated position in order to align the axis of rotation 34 and thus the optical axis of the imaging optical system to a target, then also the bearing body 16 is pivoted with the rotor 32 through the ball bearing 30. The hollow body 52 in the bearing surface 50 of the peripheral portion 48 of the cooler housing 46 is simultaneously rotated through the links 64. The surface of the detector chip 62 always remains in the plane 42 in which a sharp image of the field of view is generated.

In the cooler housing 46, a Joule-Thomson cooler 66 is arranged (FIG. 2) which is not illustrated in FIG. 1 for reasons of clarity.

FIG. 2 shows in enlarged scale a modified embodiment of a seeker having detector chip 62 in a cooler housing 46, in which the detector chip is pivotable with the axis of rotation 34 of the rotor 32 relative to the cooler housing 46. The basic construction of the seeker is the same as in FIG. 1 and therefore is not illustrated once again in FIG. 2. Corresponding portions are designated by the same numerals in FIG. 1 and in FIG. 2.

In the embodiment of FIG. 2 the hollow body 52 is directly coupled to the rotor 32 through a connecting piece 68 and a ball bearing 69. Also here the detector chip 62 is pivoted with the rotor 32. The surface of the detector chip always remains in the plane 42 passing through the central point.

Figure 3:
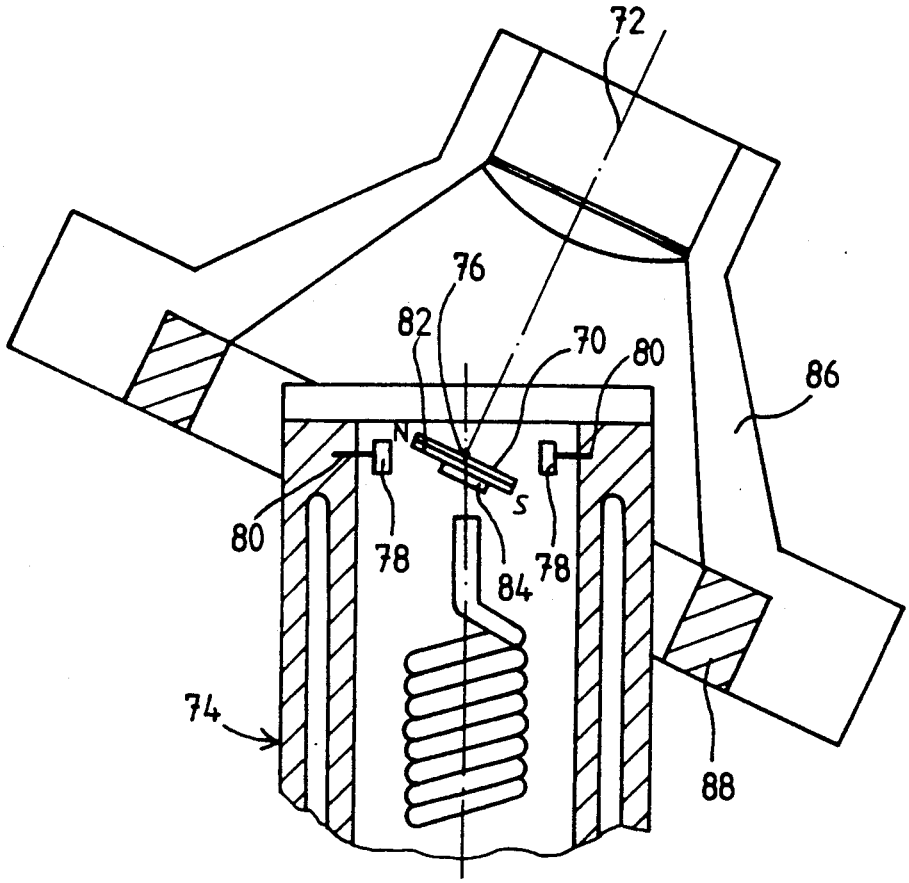
FIG. 3 shows a further embodiment in which the detector chip is aligned by magnetic forces.

In the embodiment of FIG. 3 the detector chip 70 is aligned with the axis of rotation 72 of the rotor by magnetic forces. The detector chip 70 is located within a cooler housing 74. The detector chip 70 is universally movably mounted about a central point 76 through a gimbal suspension. To this end a gimbal ring 78 is pivotably mounted with bearings 80 in the cooler housing 74 about a first axis passing through the central point and extending horizontally in the paper plane in FIG. 3. The detector chip 70 is, in turn, mounted in the gimbal ring 78 about a second axis which likewise extends through the central point and is perpendicular to the first axis. A first bar magnet 82 is attached to the detector chip 70 and extends parallel to the plane of the detector chip 70 in the longitudinal plane containing the first axis. This is the paper plane of FIG. 3. A second bar magnet 84 is arranged crossly to the first bar magnet 82.

A ring 88 of a material of high permeability, e.g. soft iron, is located in a portion 86 on the rotor side. The portion 86 on the rotor side can be a bearing portion similar to the bearing portion 16 of FIG. 1. However, the portion 86 on the rotor side can be the rotor itself, similar as in the arrangement of FIG. 2. The transverse center plane of the ring 88 preferably also includes the central point 76 and extends perpendicular to the axis of rotation 72 of the rotor and the optical axis of the imaging optical system.

The detector chip 70 is held in the transverse center plane of the ring 88 by the magnetic force lines extending through the bar magnets 82 and 84 and the ring 88. Thus, the detector chip will follow a pivotal movement of the rotor without contact. Also here the surface of the detector chip 70 always remains in the image plane of the optical system in which the field of view is sharply imaged.

In the embodiment of FIG. 3 the basic construction of the seeker is again similar to that of FIG. 1.

As described, the detector chip can comprise a two-dimensional arrangement of detector elements. Thereby the image points of the detected field of view are measured in parallel. The detector elements supply target signals when a target is detected. Aligning signals are generated from the target signals by image processing means and control means in known and thus not illustrated manner, which aligning signals align the seeker to the target. Furthermore, steering signals are generated which guide the missile to the target.

Instead, the detector chip can also have a linear arrangement of detector elements. The same problem occurs with such a linear arrangement. In this case a scanning movement has to be provided. This scanning movement can be achieved by image rotating means. Such image rotating means can consist in the concave mirror 36 in FIG. 1 being slightly inclined relative to the axis of rotation. In any case, there is no need to provide two synchronized scanning movements with different rotary speeds as with a rosette-scanning.

Figure 4:
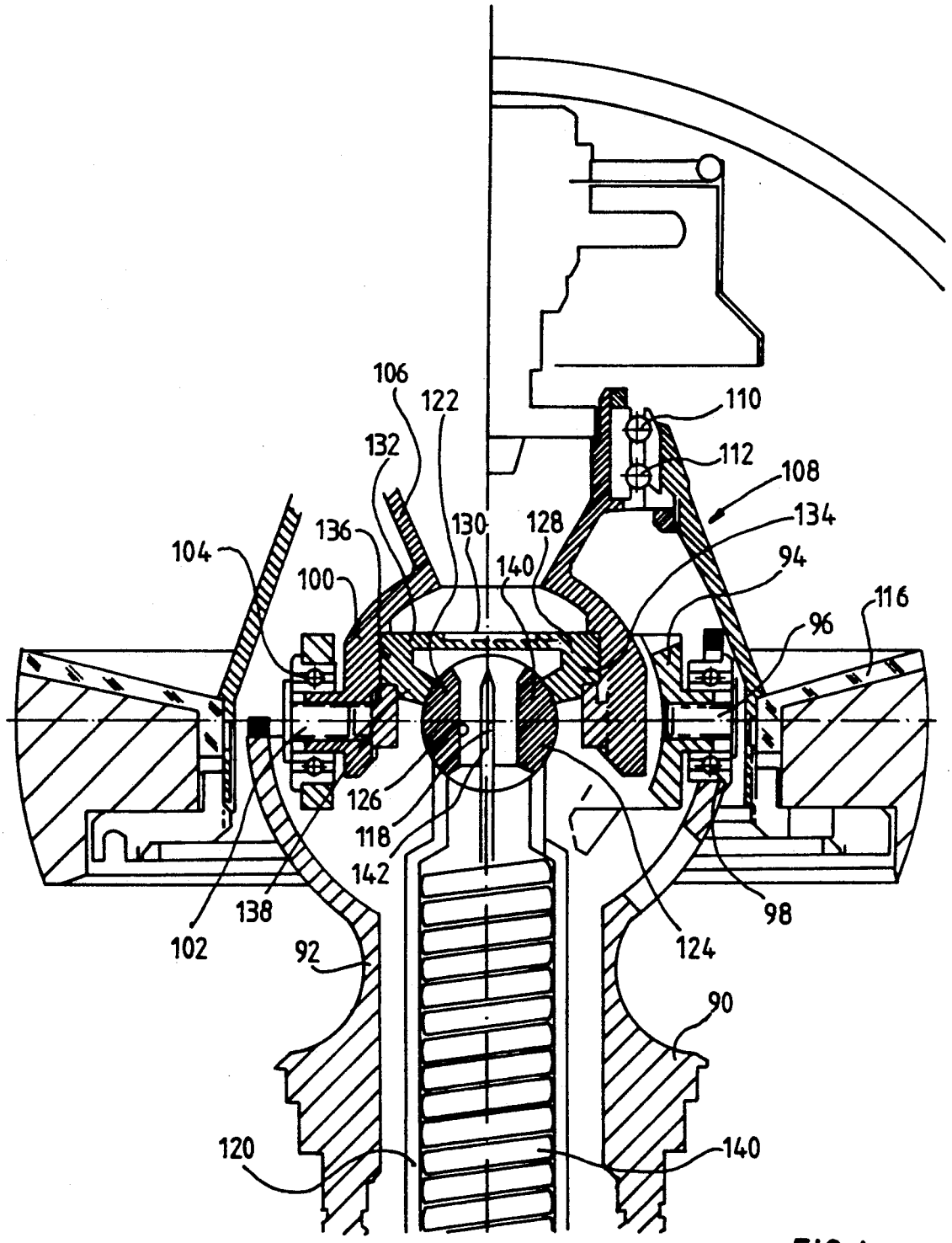
FIG. 4 shows a partial longitudinal section of a further embodiment of a seeker having detector means adapted to be aligned.

FIG. 4 shows a longitudinal section through a seeker, with the cutting plane in the right half of the figure being perpendicular to the cutting plane in the left half.

Numeral 90 designates a structure-fixed tubular portion which ends in a spherical cup 92. An outer gimbal 94 of a gimbal suspension is mounted with pins 96 through ball bearings 98 in the cup 92. In a plane perpendicular to the plane of these bearings, to the left in the figure, an inner gimbal 100 is mounted with pins 102 through ball bearings 104 in the outer gimbal 94. The inner gimbal 100 is connected to a rotor carrier 106 on which a rotor 108 is rotatably mounted through ball bearings 100, 112. The rotor 108 carries a concave mirror 116 which constitutes part of the imaging optical system. Another part of the imaging optical system is located on the rotor carrier 106. The rotor carrier 106 and thus the rotor 108 can be universally pivoted about a structure-fixed central point 118. The central point 118 is the intersection point of the pivot axes of the gimbals 94 and 100.

A tubular peripheral portion of the cooler housing 120 is located within the structure-fixed tubular portion 90 and coaxially thereto. An annular body 122 is located at the end of the peripheral portion on the rotor side. The annular body 122 has a convexo-spherical bearing surface 124. A bore 126 extends centrally through the annular body 122. A carrier 128 carries detector means 130. The detector means 130 are formed by a linear or two-dimensional arrangement of detector elements. The carrier 128 consists of a carrier plate 132 which carries the detector means 130 and which is mounted with a retracted edge 134 on the convexo-spherical bearing surface 124 of the annular body 122. The edge 134 has a cylindrical section 136 and a section 138 extending inwards therefrom. An annular concavo-spherical bearing surface 140 is formed at the section 138, with which bearing surface 140 the carrier 128 is mounted on the convexo-spherical bearing surface 124 complementary thereto. The carrier 128 is held in the rotor carrier 106 and pivotable therewith about the central point 118.

A tube coil 140 of a Joule-Thomson cooler is located within the cooler housing 120, which tube coil 140 ends in a decompression nozzle 142. The decompression nozzle 142 extends centrally through the bore 126 and is directed toward the detector means 130. Pressurized gas is supplied through the tube coil 140. The pressurized gas expands in the decompression nozzle 142 and is cooled down thereby. The cooled-down gas flows through the tube coil 140 and effects pre-cooling of the supplied pressurized gas. Very low temperatures can be achieved in this way. The detector means 130 are cooled with these low temperatures of the emerging and expanding pressurized gas.

The described construction permits a larger squint angle than the construction of FIG. 1.

Figure 5:
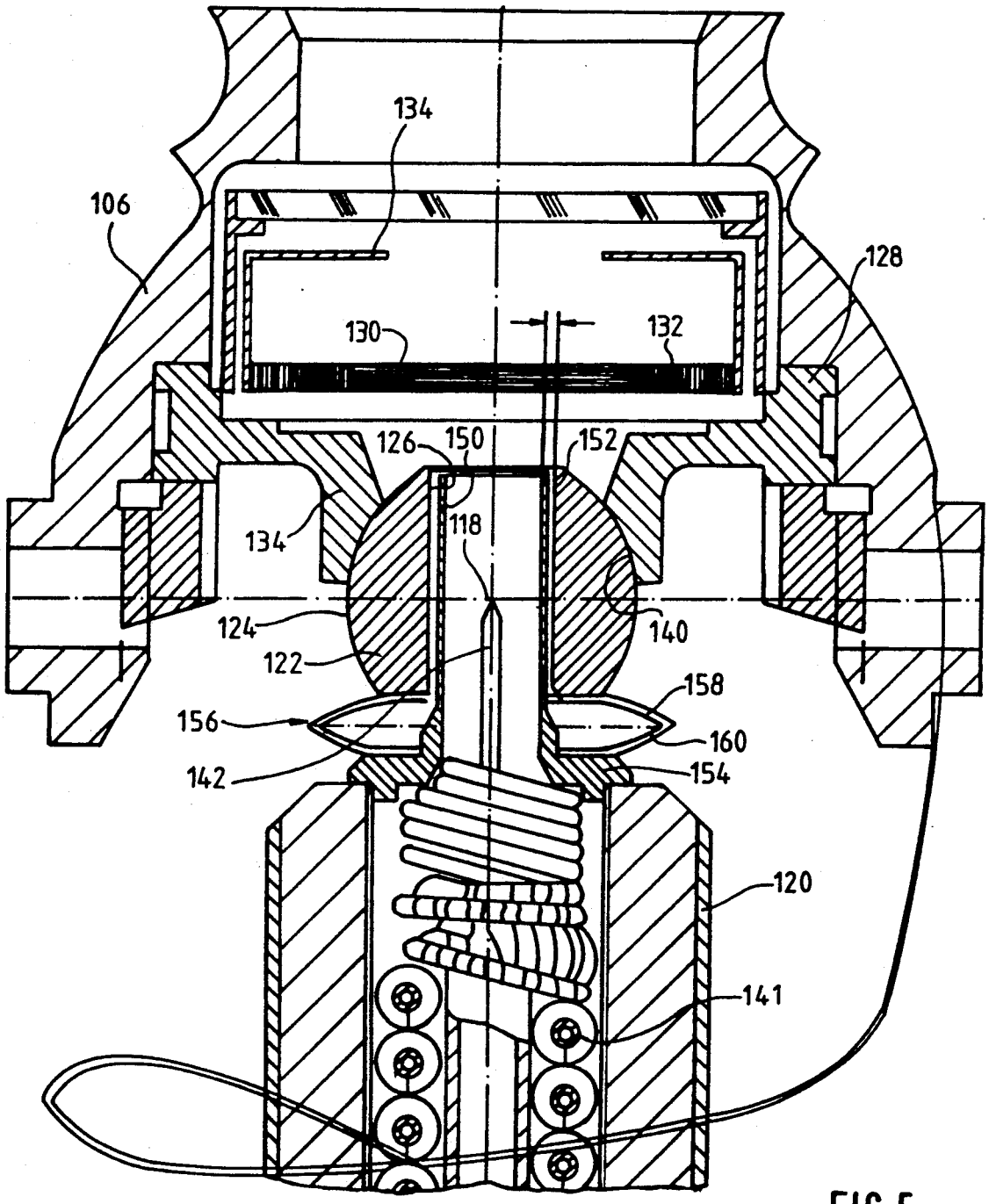
FIG. 5 shows a modification of the seeker of FIG. 4 in a partial longitudinal section.

FIG. 5 shows a longitudinal section through the detector arrangement and the non-rotating inner portion of the seeker, with the seeker, for the rest, being similarly constructed as in FIG. 4.

A heat-insulating tubular cooler housing 120 is located within a (not illustrated) structure-fixed tubular portion and coaxially thereto. An annular bearing body 122 is located at the end of the cooler housing 120 on the rotor side. The annular bearing body 122 has a convexo-spherical bearing surface 124. A bore 126 extends centrally through the annular bearing body 122. A carrier 128 carries detector means 130. The detector means 130 are formed by a linear or two-dimensional arrangement of detector elements. The carrier 128 consists of a carrier plate 132 which carries the detector means 130 and which is mounted with a retracted edge 134 on the convexo-spherical bearing surface 124 of the annular bearing body 122. The carrier 128 is held in the rotor carrier 106 and pivotable therewith about the central point 118.

A tube coil 141 of a Joule-Thomson cooler is located within the cooler housing 120, which tube coil 141 ends in a decompression nozzle 142. The decompression nozzle 142 extends centally through the bore 126 and is directed toward the detector means 130. Pressurized gas is supplied through the tube coil 141. The pressurized gas expands in the decompression nozzle 142 and is cooled down therewith. The cooled-down gas flows through the tube coil 141 and effects pre-cooling of the supplied pressurized gas. Very low temperatures can be achieved in this way. The detector means 130 are cooled with these low temperatures of the emerging and expanding pressurized gas.

In the embodiment illustrated in FIG. 5 the annular bearing body 122 is a ball having a bore 126. The bearing body 122 having the bore 126 is located with clearance on a guiding socket 150. Thereby a slot 152 of some tenth of millimeters thickness is formed between the guiding socket 150 and the inner wall of the bore 126.

The cooler housing 120 is closed at its front side by an annular disc 154. The annular disc 154 carries the guiding socket 150 which is integral with the annular disc 154. The bore 126 extends through the annular disc 154. The bearing body 122 is connected to the annular disc 154 through a spring bellows 156. In the illustrated embodiment the spring bellows consists of two annular cup springs 158 and 160 which are connected to the bearing body 122 and the annular disc, respectively, along their inner edges and connected to each other along their outer edges. In this way the space within the carrier 128 communicates with the interior of the spring bellows 156 through the slot 152, in which space high pressures can arise. Thereby, the bearing body 122 is pressed with a pressure-proportional force against the bearing surface 140 of the carrier 134. In this way a safe sealing is ensured between the bearing surfaces 124 and 135. Therefore, the gas emerging from the decompression nozzle has to flow through the interior of the guiding socket 150 and of the cooler housing 120 through the tube coil 141. Thereby the tube coil 141 is precooled.

The slot 152 and the spring bellows 156 permit a radial and axial compensating movement of the bearing body 122 such that the central point of the bearing surface 124 can be aligned to the central point 118 of the rotor bearing, i.e. the intersection point of the gimbal axes.

Finally, the slot 152 effects a heat insulation between the carrier 106 and the bearing body, on one hand, and the guiding socket and the decompression nozzle, on the other hand. Less heat flows from the bearing body to the expanding and cooled gas guided in the guiding socket 150 to the detector means. This results in a faster cooling down of the detector means 130.

We claim:

1. Gyro-stabilized seeker, comprising (a) a rotor (32) which is mounted universally movably about a central point (20) and arranged to be driven about a rotor-fixed axis of rotation (34) passing through the central point (20), (b) an imaging optical system (36, 40, 28) on the rotor (32) which is arranged to image a field of view in a plane perpendicular to the axis of rotation (34) of the rotor (32), (c) detector means (62) upon which the field of view is imaged by the optical system for generating target signals, (d) means for generating aligning signals from the target signals, (e) a structure-fixed cooler housing (46) at which the detector means (62) are arranged, (f) means (66) for cooling the detector means (62), and (g) aligning means (44) to which the aligning signals are applied for aligning the axis of rotation (34) of the rotor (32) to a target, characterized in that (h) the detector means (62) are arranged around the central point (20) universally pivotably relative to the structure-fixed cooler housing (46) and (i) coupling means (64) are arranged to align the detector means (62) with its plane always perpendicular to the axis of rotation (34) of the rotor (32).

2. Gyro-stabilized seeker as set forth in claim 1, characterized in that (a) the cooler housing (46) has a cylindrical peripheral portion (48) which forms a concavo-spherical bearing surface (50) at its end facing the rotor (32), (b) a hollow body (52) is mounted in the bearing surface (50) of the peripheral portion (48), which hollow body (52) has a convexo-spherical peripheral surface about a hollow body axis (56) and which is closed on the side facing the rotor (32) by a window (58) which is transparent for radiation and perpendicular to the hollow body axis (56), whereas an annular wall portion (60) is formed on the side facing the interior of the cooler housing (46), the central opening of the wall portion (60) being closed by the detector means (62) likewise perpendicular to the hollow body axis (56), and (c) the hollow body (52) is coupled to the rotor (32) through mechanical aligning elements (64,16;68) and a bearing (30;70) such that the hollow body (52) with its hollow body axis (56) is aligned with the axis of rotation (34) of the rotor (32).

3. Gyro-stabilized seeker as set forth in claim 2, characterized in that (a) the rotor (32) is mounted rotatably about the axis of rotation (34) by means of the bearing (30) on a non-rotating bearing portion (16) which is mounted universally pivotable relative to the structure (10), and (b) the hollow body (52) is connected to the non-rotating bearing portion (16) through the aligning elements (64).

4. Gyro-stabilized seeker as set forth in claim 2, characterized in that the aligning elements (68), on one hand, are attached to the hollow body (52) and, on the other hand, are mounted directly at the rotating rotor (32) through bearings (69).

5. Gyro-stabilized seeker as set forth in claim 1, characterized in that (a) the detector means (70) in the cooler housing (74) are mounted universally movable about the cental point (76) and (b) contactless alining means (82,84,88) are provided which are arranged to align the detector means (70) to the axis of rotation (72) of the rotor.

6. Gyro-stabilized seeker as set forth in claim 5, characterized in that the contactless aligning means include magnetic means.

7. Gyro-stabilized seeker as set forth in claim 6, characterized in that the contactless aligning means comprise a pair of crossed permanent magnets (82,84) at the detector means (70) and a ring (88) of a material of high permeability which is pivotable with the axis of rotation (72) of the rotor.

8. Gyro-stabilized seeker as set forth in claim 1, characterized in that the detector means are formed by a detector chip (62).

9. Gyro-stabilized seeker as set forth in claim 8, characterized in that the detector chip (62) has a two-dimensional arrangement of detector elements.

10. Gyro-stabilized seeker as set forth in claim 8, characterized in that (a) the detector chip (62) comprises a linear arrangement of detector elements and (b) the imaging optical system comprise image rotating means which rotate with the rotor.

11. Gyro-stabilized seeker as set forth in claim 1, characterized in that (a) a convexo-spherical bearing surface (124) is structure-fixedly attached to the cooler housing (120) and (b) the detector means (130) are located on a movable carrier (128) which is mounted universally pivotable on the convexo-spherical bearing surface (124).

12. Gyro-stabilized seeker as set forth in claim 11, characterized in that (a) the convexo-spherical bearing surface (124) is provided on an annular body (122), (b) the cooling means comprise a Joule-Thomson-cooler having a decompression nozzle (142) which extends through a central bore (126) of the annular body (122), and (c) the carrier (128) of the detector means (130) connected to a rotor carrier (106) forms a carrier plate (132) on which the detector means (130) are arranged in the jet area of the decompression nozzle (142) and which is mounted with a retracted edge (134) on the convexo-spherical bearing surface (124).

13. Gyro-stabilized seeker as set forth in claim 12, characterized in that the edge (134) of the carrier plate (132) forms a concavo-spherical bearing surface (140).

14. Gyro-stabilized seeker as set forth in claim 11, characterized in that the detector means (130) is connected to signal regeneration and signal processing means connected to the output thereof through a flexible line spiral which is put around the cooler housing (120).

15. Gyro-stabilized seeker as set forth in claim 11, characterized in that the convexo-spherical bearing surface (124) is connected to the cooler housing (120) through resilient connecting means (156) permitting alignment of the central point of the bearing surface (124) to the central point of the rotor bearing.

16. Gyro-stabilized seeker as set forth in claim 15, characterized in that (a) a cylindrical guiding socket (150) is provided at the end of the cooler housing at the side of the field of view and (b) the convexo-spherical bearing surface (124) is formed at a bearing body (122) which is guided on the guiding socket (150) with a bore (126) having lateral clearance.

17. Gyro-stabilized seeker as set forth in claim 16, characterized in that the bearing body (128) is connected to the cooler housing (120) through a spring bellows (156) permitting an axial movement.

18. Gyro-stabilized seeker as set forth in claim 17, characterized in that (a) the cooler housing (120) is closed at its front surface by an annular disc (154) carrying the guiding socket (150) and (b) the spring bellows (156) connects the annular disc (154) to the bearing body (122).

* * * * *